US007150600B1

(12) United States Patent
Vennat

(10) Patent No.: US 7,150,600 B1
(45) Date of Patent: Dec. 19, 2006

(54) DOWNHOLE TURBOMACHINES FOR HANDLING TWO-PHASE FLOW

(75) Inventor: Jose John Vennat, Edmond, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 461 days.

(21) Appl. No.: 10/632,577

(22) Filed: Jul. 28, 2003
(Under 37 CFR 1.47)

Related U.S. Application Data

(60) Provisional application No. 60/422,648, filed on Oct. 31, 2002.

(51) Int. Cl.
*F04D 1/06* (2006.01)
*F01D 19/02* (2006.01)

(52) U.S. Cl. ..... 415/199.2; 415/199.6; 415/211.2; 415/218.1; 415/104

(58) Field of Classification Search ..... 415/199.1, 415/199.2, 211.2, 224.5, 219.1, 221, 104, 415/218.1; 416/198 R, 203
See application file for complete search history.

(56) References Cited

U.S. PATENT DOCUMENTS

| | | | | |
|---|---|---|---|---|
| 3,168,048 | A * | 2/1965 | Tonitaro et al. | 415/221 |
| 3,936,225 | A | 2/1976 | Stjernstrom | |
| 5,173,022 | A | 12/1992 | Sango | |
| 5,562,405 | A | 10/1996 | Ryall | |
| 5,628,616 | A * | 5/1997 | Lee | 415/58.2 |
| 5,755,554 | A | 5/1998 | Ryall | |
| 6,149,385 | A | 11/2000 | Vilagines et al. | |
| 6,273,672 | B1 | 8/2001 | Charron | |
| 6,547,514 | B1 | 4/2003 | Lee | |
| 6,676,366 | B1 * | 1/2004 | Kao | 415/1 |

* cited by examiner

*Primary Examiner*—Ninh H. Nguyen
(74) *Attorney, Agent, or Firm*—Crowe & Dunlevy, P.C.

(57) ABSTRACT

Disclosed is a submersible pump assembly for handling two-phase flow. The pump assembly preferably includes a housing and a first stage. The first stage includes an impeller assembly and a diffuser assembly, which are collectively configured to produce a diagonal flow path through the first stage.

9 Claims, 3 Drawing Sheets

DOWNHOLE TURBOMACHINES FOR HANDLING TWO-PHASE FLOW

RELATED APPLICATIONS

This application claims the benefit of U.S. Provisional Patent Application No. 60/422,648, entitled Multi-Stage Turbomachines for Handling Two Phase Flow, filed Oct. 31, 2002, which is herein incorporated by reference.

FIELD OF THE INVENTION

This invention relates generally to the field of downhole turbomachines, and more particularly to downhole turbomachines optimized for pumping two-phase fluids.

BACKGROUND

Submersible pumping systems are often deployed into wells to recover petroleum fluids from subterranean reservoirs. Typically, a submersible pumping system includes a number of components, including an electric motor coupled to one or more high performance pump assemblies. Production tubing is connected to the pump assemblies to deliver the petroleum fluids from the subterranean reservoir to a storage facility on the surface. The pump assemblies often employ axially and centrifugally oriented multi-stage turbomachines.

Although widely used, conventional downhole turbomachinery is vulnerable to "gas locking," which occurs in locations where petroleum fluids include a significant gas to liquid ratio. Gas locking often causes the inefficient operation or complete failure of downhole turbomachinery. The gas-locking phenomenon can be explained by the dynamics of fluid flow through the impeller and diffuser. The streamwise and transverse pressure gradients, streamline curvature and slip between different phases contribute to the segregation of the phases. Upon separation, the gas phase tends to accumulate in certain regions of the flow passage, causing head degradation and gas locking.

Numerous attempts have been made to lessen the adverse effects of gas locking. Gas separator units have been frequently used in conjunction with submersible pump assemblies to reduce the volume of gas in the petroleum fluids being pumped to the surface. In other cases, separate helical "compressor" pumps have been used to reduce the volume of the gas before introducing the petroleum fluid to the primary pumping assembly. Although functional, these prior art solutions require the fabrication and assembly of additional components, decreases the overall efficiency of the submersible pumping system and elevate the risk of mechanical failure.

There is therefore a continued need for an improved pump assembly that effectively and efficiently produces two-phase fluids from subterranean reservoirs. It is to these and other deficiencies in the prior art that the present invention is directed.

SUMMARY OF THE INVENTION

The present invention includes a pump assembly useable for pumping two-phase fluids from a subterranean well. In a preferred embodiment, the pump assembly includes a housing and at least one stage contained within the housing. The first stage includes an impeller assembly and a diffuser assembly, which are collectively configured to form a diagonal flow path through the first stage. The diagonal flow path reduces the separation of the gas phase from the liquid phase as fluid moves through the first stage. These and various other features and advantages that characterize the present invention will be apparent from a reading of the following detailed description and a review of the associated drawings.

DETAILED DESCRIPTION OF THE PREFERRED EMBODIMENT

Figure 1:
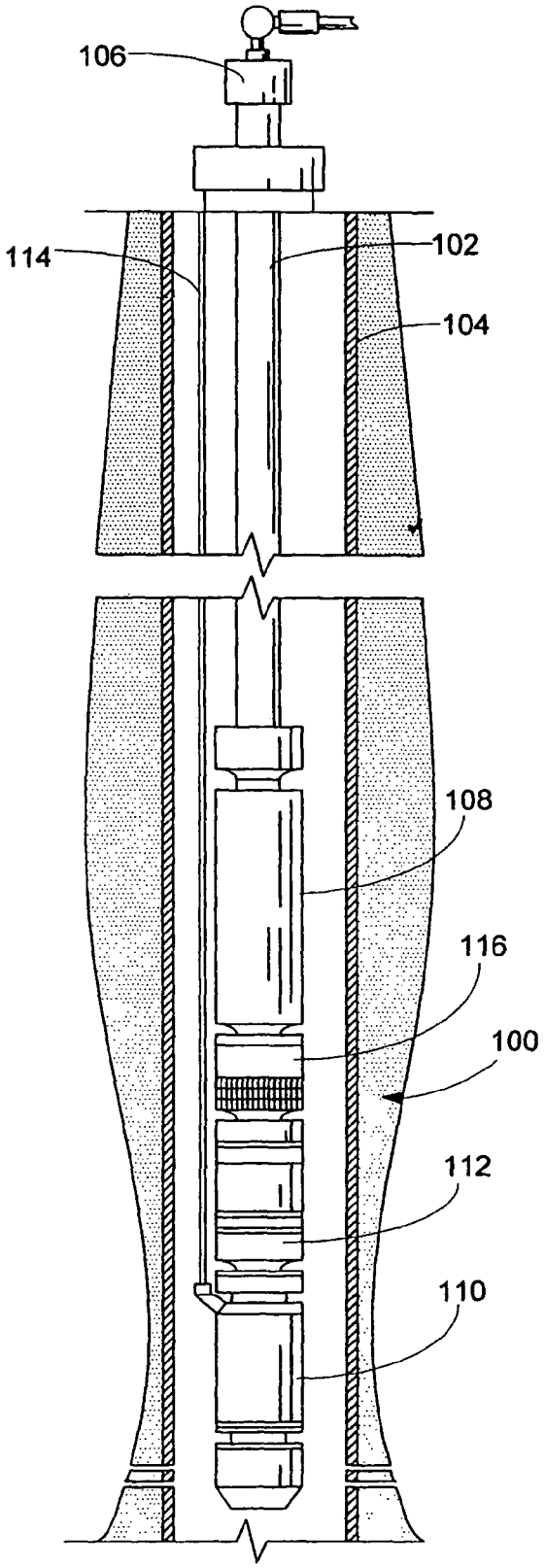
FIG. 1 is an elevational view of an electric submersible pumping system disposed in a wellbore constructed in accordance with a preferred embodiment of the present invention.

In accordance with a preferred embodiment of the present invention, FIG. 1 shows an elevational view of a pumping system 100 attached to production tubing 102. The pumping system 100 and production tubing are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids.

The pumping system 100 preferably includes some combination of a pump assembly 108, a motor assembly 110 and a motor protector 112. The motor protector 112 shields the motor assembly 110 from mechanical thrust produced by the pump assembly 108. The motor assembly 110 is provided with power from the surface by a power cable 114.

Although only one pump assembly 108 and one motor assembly 110 are shown, it will be understood that more can be connected when appropriate. The pump assembly 108 is preferably fitted with an intake section 116 to allow well fluids from the wellbore 104 to enter the pump assembly 108, where the well fluid is forced to the surface through the production tubing 102.

Figure 2:
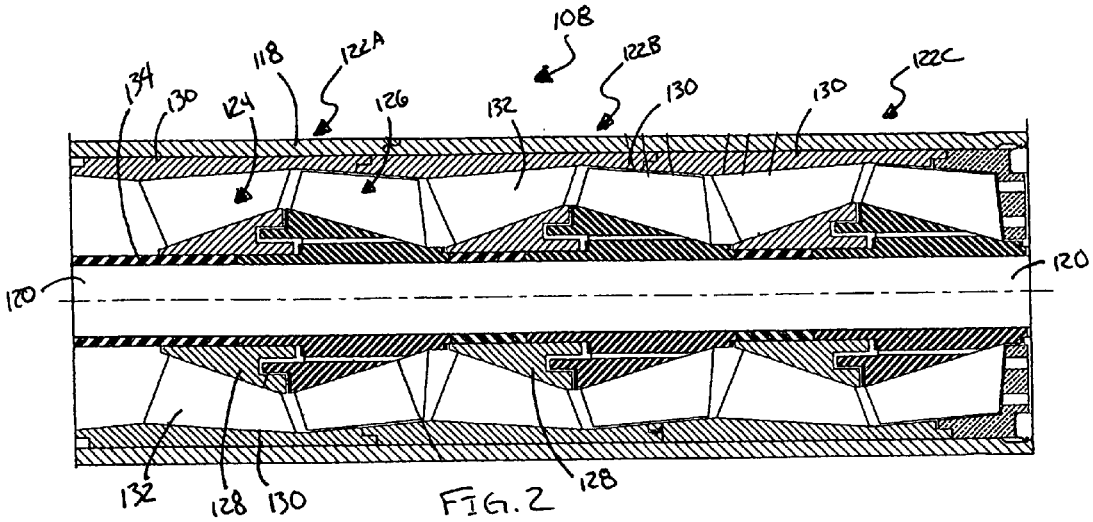
FIG. 2 is a side cross-sectional view of a portion of the pump assembly of FIG. 1.

Referring to FIG. 2, shown therein is a cross-sectional view of a portion of the pump assembly 108 in a horizontal position. The pump assembly 108 preferably includes a housing 118 and a centrally disposed shaft 120. The shaft 120 is configured to rotate about the longitudinal axis of the pump assembly 108 that is illustrated by dashed lines in FIG. 2. The shaft 120 transfers the mechanical energy from the motor assembly 110 to the working components of the pump assembly 108. The housing 118 and shaft 120 are preferably substantially cylindrical and fabricated from a durable, corrosion-resistant material, such as steel or steel alloy. Unless otherwise specified, each of the components described in the downhole pumping system 100 is constructed from steel, aluminum or other suitable metal alloy.

The pump assembly also includes at least one turbomachinery stage 122. Three stages (122*a*, 122*b* and 122*c*, collectively referred to as "stages 122") are included in the portion of the pump assembly 108 shown in FIG. 2. Each stage 122 preferably includes a stationary diffuser 124 fixed to the housing 118 and a rotating impeller 126 fixed to the shaft 120. The impeller 126 and diffuser 124 are preferably fixed to the shaft 120 and housing 118, respectively, with keyed or press-fit connections, although a variety of alternative methods are also acceptable.

The diffuser 124 includes a diffuser hub 128, a diffuser shroud 130, at least one diffuser vane 132 and a bearing 134. The diffuser shroud 130 is configured to fit within the inner surface the housing 118. As one of ordinary skill in the art will recognize, the number and design of the at least one diffuser vane 132 is based on application-specific requirements and not limited by the present invention.

The bearing 134 surrounds the shaft 120 and is preferably captured by a portion of the inner diameter of the diffuser hub 128. In this way, the bearing 134 facilitates the rotational movement of the shaft 120 within the confines of the stationary diffuser hub 128. The bearing 134 can be secured to the inner diameter of the diffuser hub 128 or the outer diameter of the shaft 120. Alternatively, the bearing 134 can remain free to rotate with respect to the diffuser hub 128 and the shaft 120. The bearing 134 is preferably constructed from a hardened material, such as tungsten carbide, silicon carbide, zirconia, peek, graphalloy or similar material.

The profile of the outer diameter of the diffuser hub 128 and the inner diameter of the diffuser shroud 130 are formed by the revolution of at least one line segment that is inclined at an angle to the longitudinal axis of the pump assembly 108. In the preferred embodiment shown in FIG. 2, the profile of the diffuser hub 128 resembles a truncated conical form with a linearly decreasing outer diameter in the downstream direction. The inner diameter of the diffuser shroud 130 also linearly decreases in the downstream direction from the leading edge of the diffuser vane 132. As a result, fluid passing through the diffuser 126 tends to converge toward the center of the stage 122 in a substantially linear path.

The impeller 126 includes an impeller shroud line 136, an impeller hub 138, one or more impeller vanes 140, at least one balance hole 142 and one or more thrust washers 144. As one of ordinary skill in the art will recognize, the number and design of the one or more impeller vanes 140 is based on application-specific requirements and not limited by the present invention. The bearing impeller 126 is preferably constructed from a hardened material, such as tungsten carbide, silicon carbide, zirconia, peek, graphalloy or similar material. The balance hole 142 reduces the axial thrust by partially equalizing pressure across a central portion of the impeller 126.

Figure 4:
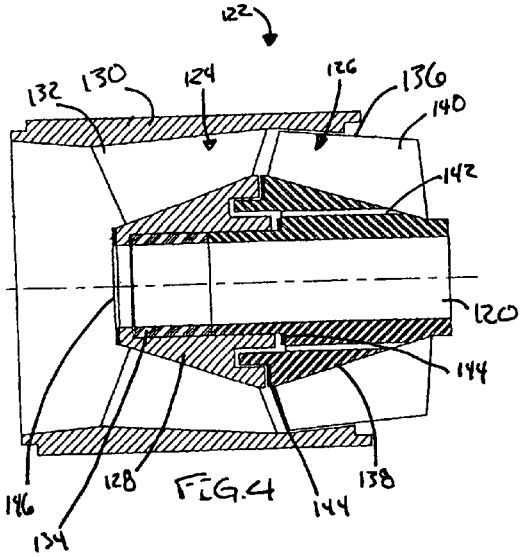
FIG. 4 is a side cross-sectional view of an alternatively preferred embodiment of a single stage of the pump assembly of FIG. 2.

The thrust washers 144 restrict the axial movement of the impeller 126. In the preferred embodiment, the thrust washers 144 are attached to the impeller hub 138. In an alternatively preferred embodiment, the thrust washers can be secured to the diffuser 124. As shown in FIG. 4, a downthrust washer 146 is attached to the downstream side of the diffuser 124. The placement of the downthrust washer 146 on the diffuser 124 increases the durability and longevity of the washer.

Figure 3:
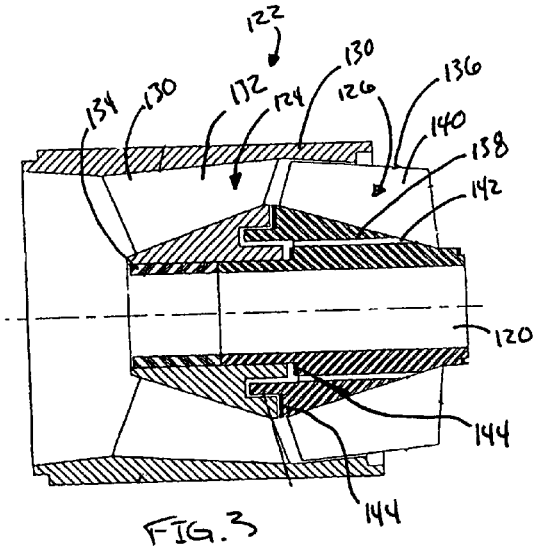
FIG. 3 is a side cross-sectional view of a preferred embodiment of a single stage of the pump assembly of FIG. 2.

In the preferred embodiment, the impeller 126 is confined between adjacent diffusers 124. Accordingly, the impeller shroud line 136 is defined by the portion of the diffuser shroud 130 that surrounds the impeller vanes 140, as shown in FIGS. 2, 3 and 4. In an alternative embodiment, the impeller shroud line 136 is fabricated as a separate member adjacent to the diffuser shroud 130.

The profile of the outer diameter of the impeller hub 138 and the impeller shroud line 136 are formed by the revolution of at least one line segment that is inclined at an angle to the longitudinal axis of the pump assembly 108. In the preferred embodiments shown in FIGS. 2, 3 and 4, the profile of the impeller hub 138 resembles a truncated conical form with a linearly increasing outer diameter in the downstream direction. The inner diameter of the impeller shroud line 136 linearly increases in the downstream direction. Thus, in contrast to the diffuser 124 described above, fluid passing through the impeller 126 tends to diverge away from the center of the stage 122 in a substantially linear fashion.

Unlike prior downhole turbomachinery designs, the diffuser 124 and impeller 126 are configured to form a diagonal flow path for fluid moving through the stage 122. In the preferred embodiments described above, the fluid diverges away from the center of the stage 122 along a linear path and then redirects on a second linear path at an angle to the first linear path in a converging manner toward the center of the stage. The movement of fluid through the angular, or "diagonal" flow paths created by the stage 122 reduces the separation of the gas and liquid phases. Based on the requirements of the particular application, the angles at which the fluids are directed within the stage 122 may vary within a single pump assembly 108. Additionally, it may be desirable to employ diffusers 124 and impellers 126 that include flow paths bounded by surfaces that are defined by multiple angular line segments.

Figure 5:
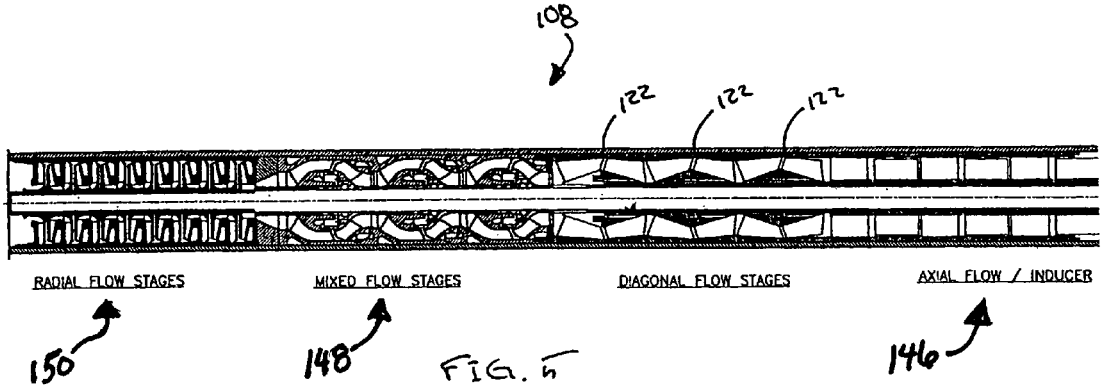
FIG. 5 is cross-sectional view of a pump assembly constructed in accordance with an alternative embodiment of the present invention with multiple types of stages.

Turning next to FIG. 5, shown therein is a cross-sectional view of an alternate embodiment of the pump assembly 108. As shown in FIG. 5, the pump assembly 108 includes a number of alternatively designed stages in addition to the diagonal flow stages 122 described above. More particularly, the pump assembly 108 includes axial flow stages 146, diagonal flow stages 122, mixed flow stages 148 and radial flow stages 150.

Figure 6:
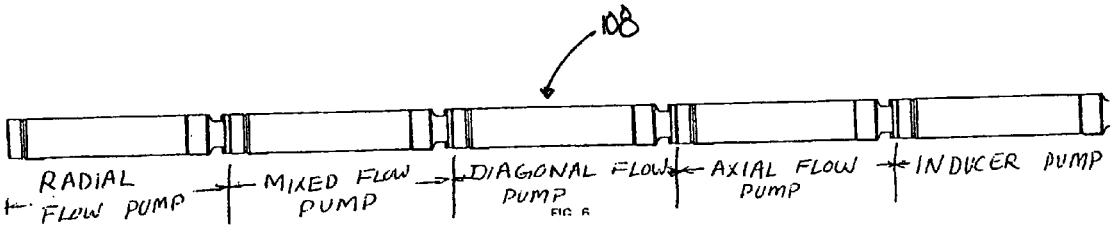
FIG. 6 is a side view of a portion of the pumping system constructed in accordance with an alternative embodiment of the present invention with multiple pump assemblies.

In this embodiment, the fluid is pulled into the pump assembly with the axial flow stages 146 and delivered to the diagonal flow stages 122 for the conditioning of two-phase flow. Once the gas phase has been effectively entrained into the liquid phase by the diagonal flow stages 122, the pressure of the fluid is increased by the mixed flow and radial flow stages 148, 150. Thus, the diagonal flow stages 122 can be used in conjunction with a number of different stages within the housing 118 to optimize the performance of the pump assembly 108 according to the requirements of individual applications. Alternatively, as shown in FIG. 6, a pump assembly 108 loaded with the diagonal flow stages 122 can be used in combination with separate pump assemblies to meet the requirements of a particular application.

In accordance with one aspect of a preferred embodiment, the present invention provides a pump assembly that includes axial flow turbomachinery configured to manage two-phase fluids. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A downhole submersible pumping system, comprising:

a motor;

production tubing; and a first pumping assembly coupled to the motor and production tubing, wherein the first pumping assembly includes at least one stage that is configured to produce a diagonal flow path, a plurality of turbomachinery stages configured to produce a diagonal flow path, and at least one turbomachinery stage configured to produce a non-diagonal flow path.

2. The downhole submersible pumping system of claim 1, further comprising a second pump assembly coupled between the first pumping assembly and the production tubing, wherein the second pump assembly is configured to produce radial flow profiles.

3. The first pumping assembly of claim 1, wherein the stage that is configured to produce a diagonal flow path includes an impeller and a diffuser.

4. The first pumping assembly of claim 1, the stage configured to produce a diagonal flow path comprising:

an impeller assembly; and a diffuser assembly, the diffuser assembly comprising:

a diffuser hub having a diffuser hub profiles, wherein the diffuser hub profile is formed by the revolution of a first line segment that is inclined to the longitudinal axis of the first pumping assembly; and a diffuser shroud having a diffuser shroud profile.

5. The first pumping assembly of claim 4, wherein the diffuser shroud profile is formed by the revolution of a second line segment not parallel or co-linear to the first line segment that is inclined to the longitudinal axis of the first pumping assembly.

6. The first pumping assembly of claim 4, wherein the diffuser assembly further comprises a thrust washer.

7. The first pumping assembly of claim 1, the stage configured to produce a diagonal flow path comprising:

an impeller assembly, the impeller assembly comprising:

an impeller hub having an impeller hub profile, wherein the impeller hub profile is formed by the revolution of a third line segment that is inclined to the longitudinal axis of the first pumping assembly; and an impeller shroud line having an impeller shroud line profile; and a diffuser assembly.

8. The first pumping assembly of claim 7, wherein the impeller shroud line profile is formed by the revolution of a fourth line segment that is inclined to the longitudinal axis of the first pumping assembly.

9. The first pumping assembly of claim 7, wherein the impeller assembly further comprises a balance hole.

* * * * *